US012173967B2

(12) United States Patent
Mohaupt et al.

(10) Patent No.: US 12,173,967 B2
(45) Date of Patent: Dec. 24, 2024

(54) HEAT PIPE WITH IMPROVED PERFORMANCE UNDER DIVERSE THERMAL LOAD DISTRIBUTIONS

(71) Applicant: EURO HEAT PIPES, Nivelles (BE)

(72) Inventors: Mikael Mohaupt, Feluy (BE); Stéphane Van Oost, Rosieres (BE); Quentin Harivel, Vieux Genappe (BE)

(73) Assignee: EURO HEAT PIPES, Nivelles (BE)

( * ) Notice: Subject to any disclaimer, the term of this patent is extended or adjusted under 35 U.S.C. 154(b) by 287 days.

(21) Appl. No.: 17/749,031

(22) Filed: May 19, 2022

(65) Prior Publication Data

US 2022/0373265 A1 Nov. 24, 2022

(30) Foreign Application Priority Data

May 20, 2021 (FR) ..... 2105276

(51) Int. Cl.
*F28D 15/04* (2006.01)

(52) U.S. Cl.
CPC ..... *F28D 15/04* (2013.01)

(58) Field of Classification Search
CPC .. F28D 15/04; F28D 15/0275; F28D 15/0283; F28D 15/046; F28D 15/0233; F28F 2220/20; H05K 7/20336; H01L 23/427
USPC ..... 165/104.26
See application file for complete search history.

(56) References Cited

U.S. PATENT DOCUMENTS 6,216,343 B1 4/2001 Leland et al.
6,450,132 B1 * 9/2002 Yao ..... F28D 15/043 122/366
7,086,454 B1 * 8/2006 Hsu ..... F28D 15/046 165/104.33
7,293,601 B2 * 11/2007 Huang ..... F28D 15/046 165/104.33
7,316,264 B2 * 1/2008 Lai ..... F28D 15/046 165/104.21
7,445,039 B2 * 11/2008 Hou ..... F28D 15/025 165/104.21
7,845,394 B2 * 12/2010 Chang ..... F28D 15/046 165/104.21
7,891,413 B2 * 2/2011 Liu ..... F28D 15/046 29/890.032
9,618,275 B1 * 4/2017 Anderson ..... F28D 15/046
(Continued)

FOREIGN PATENT DOCUMENTS

DE 20 2005 021 911 U1 6/2011

*Primary Examiner* — Len Tran
*Assistant Examiner* — Gustavo A Hincapie Serna
(74) *Attorney, Agent, or Firm* — Seed IP Law Group LLP

(57) ABSTRACT

A heat pipe includes an extruded profile body, with a hollow body closed at the ends, filled with a predefined volume of diphasic working fluid. A plurality of longitudinal channels are included, with each having a section delimited by a bottom formed by one tubular peripheral wall of the profiled body, and laterally by two longitudinal dividers. A circumferential transfer channel, which is arranged transversely to the local axial direction and provides mutual fluid connection between the longitudinal channels, is provided at a position along the longitudinal path and or at an end, where the longitudinal dividers are interrupted, partially or completely, in the area of the circumferential channel, with optional use of a closure ring.

19 Claims, 7 Drawing Sheets

(56) References Cited

U.S. PATENT DOCUMENTS

2005/0230085 A1* 10/2005 Valenzuela ..... F28D 15/0233 165/104.26
2006/0169439 A1* 8/2006 Hong ..... F28D 15/046 165/104.26
2007/0193723 A1* 8/2007 Hou ..... F28D 15/0233 165/146
2007/0240855 A1* 10/2007 Hou ..... F28D 15/046 165/104.26
2007/0240858 A1* 10/2007 Hou ..... F28D 15/046 165/146
2008/0099186 A1* 5/2008 Yu ..... F28D 15/046 165/104.11
2009/0020268 A1* 1/2009 Chang ..... F28D 15/046 165/104.33
2009/0020269 A1* 1/2009 Chang ..... F28D 15/046 165/104.26
2009/0166004 A1* 7/2009 Lai ..... F28D 15/046 165/104.26
2009/0260793 A1* 10/2009 Wang ..... F28D 15/025 165/181
2009/0308576 A1* 12/2009 Wang ..... B23P 15/26 29/890.032
2010/0155032 A1* 6/2010 Wu ..... F28D 15/046 29/890.032
2010/0263833 A1* 10/2010 Lee ..... F28D 15/046 165/104.26
2011/0303392 A1* 12/2011 Horiuchi ..... F28D 15/046 165/104.26
2012/0175084 A1* 7/2012 Horng ..... F28D 15/046 165/104.26
2012/0227934 A1* 9/2012 Huang ..... F28D 15/046 29/890.032
2014/0174086 A1* 6/2014 Kare ..... F01K 11/02 60/670
2016/0014931 A1* 1/2016 Hamakawa ..... H05K 7/20336 165/104.26
2017/0122673 A1* 5/2017 Chin ..... H01L 23/427
2020/0149823 A1* 5/2020 Kawabata ..... F28D 15/046
2020/0248970 A1 8/2020 Chen
2022/0139581 A1* 5/2022 Dulloo ..... G21C 15/257 376/100
2022/0282934 A1* 9/2022 Hara ..... H05K 7/20336
2024/0011715 A1* 1/2024 Uekubo ..... F28D 15/046

* cited by examiner

HEAT PIPE WITH IMPROVED PERFORMANCE UNDER DIVERSE THERMAL LOAD DISTRIBUTIONS

BACKGROUND

Technical Field

The disclosure relates to heat pipes, thermal transfer devices, in particular for cooling a heating member.

Description of the Related Art

A heat pipe generally comprises a central axial channel in which moves a working fluid in gas form and longitudinal grooves extending axially and distributed around the central axial channel intended to move the working fluid in liquid form along a direction opposite to that of the gas.

In the case of a thermal load not uniformly distributed around the heat pipe, the grooves work in very different ways and the more solicited grooves may dry out while the others are scarcely solicited. This phenomenon can also be the consequence of an unequal and changing distribution of hot and cold sources along the heat pipe, as is frequently the case in many applications of heat pipes (e.g., heat pipe networks, distribution of heating radiators, smoothing out the temperature distribution over a relatively large surface area).

In practice, this observation leads to oversizing the heat pipe in order to avoid a groove drying out when a thermal load is not uniformly distributed or which changes over time.

The inventors sought to improve the situation.

BRIEF SUMMARY

For this purpose, a heat pipe (1) configured for being used in low or zero gravity is proposed comprising a profiled body (10) generally obtained by extrusion, where said profiled body extends along a longitudinal path (PX), and where said profiled body forms a hollow body closed at at least two ends by closing elements, thereby forming an interior space hermetically isolated from the outside environment, and filled with a predefined volume of diphasic working fluid, said profiled body comprising a plurality of longitudinal channels (3) (in practice implemented as longitudinal grooves), where each of said channels has a section delimited by a bottom (76) formed by one tubular peripheral wall (75) of the profiled body, and laterally by two longitudinal dividers (2) which extend radially inwards from the peripheral tubular wall, where the longitudinal channels surround an axial channel (15) (conveying the gas), and where the longitudinal channels are open towards the axial channel, characterized in that a circumferential transfer channel (6), which is arranged transversely to the local axial direction (X) and provides mutual fluid connection between all or part of the plurality of longitudinal channels, is provided at at least one first position (P1) along the longitudinal path (PX), and in that the longitudinal dividers are interrupted, partially or completely, in the area of the circumferential channel.

Thanks to these provisions, the grooves adjacent to the one or more grooves under the most demand for the liquid fluid supply function can be made to contribute by the circumferential transfer channel. The liquid transits through the circumferential transfer channel from a groove under less demand towards a groove under more demand. In that way, a contribution is made to pushing back the thermal load limits which could lead to a partial or complete drying of one or more grooves that are under the most demand. The parts that are under the most thermal demand are those where the vaporization flow/flow rate is the greatest.

It should be noted that the longitudinal path (PX) may or may not be straight. If the path is not straight, the axial direction is therefore local and not an absolute direction.

It should be noted that the circumferential transfer channel (6) is generally seen as an annular passage. In practice, it is most often seen as an annular groove.

It should be noted that the longitudinal channels are made as longitudinal grooves, generally resulting by extrusion and made together with the main profiled body.

It should be noted that the circumferential transfer channel can bring all the longitudinal channels into fluid communication, to which the annular passage in fact makes a complete turn. But it is not excluded that, in specific configurations with thermal loads known in advance, the circumferential transfer channel brings the longitudinal channels into fluid communication over half of the circumference (only a half-turn) or over one or more arbitrary angular ranges.

It should be noted that the section of the longitudinal channels may take various possible shapes, since the bottom is not necessarily flat, and the dividers are not necessarily straight. In a particular example, the section of the longitudinal channels has a general concavity. In a particular example, the section of the longitudinal channels may be generally a circular arc or an oval arc. In a particular example, the section of the longitudinal channels may be trapezoidal.

In various embodiments of the disclosure relating to the method, use may potentially be made of one and/or another of the following arrangements, taken individually or in combination.

According to one option, the circumferential channel makes a full turn and brings all the longitudinal channels in fluid connection. This way a homogeneous and predictable behavior is possible whatever the load distribution on the periphery of the heat pipe. Whatever part of the circumference is the most thermally loaded, the groove(s) under the most thermal demand receives additional liquid coming from the other grooves via the circumferential transfer channel.

According to an option, several circumferential transfer channels can be provided laid-out one after the other in the longitudinal direction. In that way, the liquid redistribution effect can be multiplied and the capillary pressure increased over an entire zone.

According to an option, depending on specific groove dimensions, in particular for thin circumferential grooves for example, one can shift from the covering ring which is discussed just below here.

According to an option, the circumferential transfer channel may be radially delimited on the inside by a covering ring, where the covering ring is interposed between the circumferential transfer channel and the axial channel. Advantageously, the presence of the covering ring serves to support liquid meniscus formation on the walls thereof and the walls of adjacent dividers. The presence of the covering ring serves to increase capillary pressure at this axial position of the heat pipe. Advantageously, the design of the ring is optimized for limiting the local load losses in the longitudinal flow, for the liquid or for the gas.

According to an option, the circumferential channel may be arranged at an intermediate position, where the dividers (2) are interrupted over a predefined length (L6) in this area. Thus, for a circumferential channel in an intermediate position, it can be implemented as an annular passage by means of a material removal operation with a revolving tool like a centrifugal cutter, or by electro-erosion or other general machining technique.

According to an option, in the area of the circumferential channel, the material of the dividers (2) is preferably removed over a height (H6) included between 50% and 100% of the height (H2) of the dividers.

According to an option, in the area of the circumferential channel, a divider footer remains over a residual height (H7) included between 0% and 50% of the normal height (H2) of the dividers. Keeping the divider footer serves to keep longitudinal contact lines for channeling the liquid by capillarity notwithstanding the presence of the circumferential transfer channel.

According to an option, the dividers may comprise a first bearing zone (B1) for receiving a first longitudinal end of the covering ring (4) and a second-bearing zone (B2) for receiving a second longitudinal end of the covering ring. In this way, the ring is securely held in place on the bearing zones relative to the dividers, on either side of the circumferential transfer channel.

According to an option, the covering ring (4) may comprise a central excess thickness (45) forming a radially outward shoulder received between the dividers in the area of the first and second bearing zones (B1, B2). This is a simple and robust solution, because the machining of the annular throat is relatively simple and such a ring with extra thickness can be obtained with standard turning/metalworking.

According to an option, the covering ring (4) may have a constant thickness and the first and second bearing zones are formed as flat areas (14) recessed from the summit of the dividers. By means of using a suitable cutter or two machining passes to form the circumferential channel, the ring is then a simple cylinder obtained by sawing a tube, a very good value component.

According to an option, the covering ring (4) can be made of a deformable material, either in the elastics or plastics field, such that the covering ring can be inserted from one end of the profiled body all the way to the first and second bearing zones, such that in the target position the covering ring closes the circumferential transfer channel radially inwards. At the target position, the elastic force is released or a plastic force (deformation) is applied outwards in order to make the positioning permanent.

According to an option, the first position (P1) is selected near an evaporation portion (71) of the heat pipe which is coupled to a heat source (81). In that way, the pressure equalization of the liquid phase in the longitudinal channels is optimized closest to the zone where it is best to avoid drying under heavy thermal load.

According to an option, the first position (P1) is an intermediate position along the longitudinal path. Since said intermediate position is arbitrary over the longitudinal path, the positioning of the circumferential transfer channel (or the circumferential channels) can thus be chosen freely closest to where needed.

According to an option, the first position (P1) is an end position on the longitudinal path. In this configuration, it is easier to remove material from the dividers in order to form the annular throat forming the transfer channel.

According to an option, the circumferential channel is formed in an end cap (5) fixed to an end of the profiled body. In this configuration, no reworking operation is done on the profiled body coming from extrusion. The complexity of the shapes and of the attachment is born by the end cap.

According to an option, one or more other circumferential channels are provided on the path at axial positions distinct and different from the first position. The multiple positions can advantageously be determined as a function of the application or be uniformly distributed along the longitudinal direction, over all or part of the heat pipe.

According to an option, the heat pipe may comprise a combination of circumferential channels, with some laid-out in intermediate longitudinal position and some laid-out in end position. In other words, having several circumferential channels of different types coexist does not lead to any incompatibility.

According to an option, the heat pipe may comprise a combination of different types of circumferential channels. For example, there can be annular channels (360°) at the side of the condenser, but also partially annular channels (<360°) at the side of the evaporator. If the thermal load is known, the circumferential channels can be adapted to optimize the thermal-hydraulic performance.

According to an option, a plurality of circumferential channels can be provided along the length, at uniformly spaced axial positions (P2, P3, P4), with a predetermined step, for example every 300 mm. This serves to equalize the pressures of the liquid phase in all the grooves at regular intervals along the heat pipe.

According to an option, one or more intersections, with two circumferential channels arranged on either side of each intersection, can be provided along the length of the heat pipe. In that way, the a priori harmful effect of the intersection from the perspective of hydraulic continuity between the channels is minimized.

According to an option, the heat pipe can be like a three-dimensional object. It then extends in three-dimensional Cartesian space and not simply in a plane. Advantageously, in that way total freedom of design and configuration results in order perfectly address all possible applications.

Advantageously in the proposed solutions, there is no porous layer, porous mass or porous covering in the proposed heat pipes, neither locally nor generally over the length of the heat pipe. In other words, the proposed heat pipes do not have any capillary porous material intended to provide capillary pumping.

BRIEF DESCRIPTION OF THE SEVERAL VIEWS OF THE DRAWINGS

Other aspects, goals and advantages of the disclosure will appear on reading of the following description of an embodiment of the disclosure, given for illustration and without limitation. The disclosure will be better understood in light of the attached drawings on which:

FIG. 13, broken into

FIG. 14, broken into

DETAILED DESCRIPTION

In the various figures, the same references designate identical or similar items. For reasons of clarity of the disclosure, some elements are not necessarily shown to scale.

Figure 1:
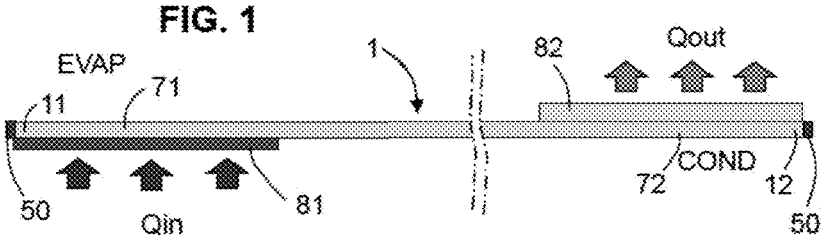
FIG. 1 schematically shows the heat pipe coupled to a heat source on one side and to a cold source on the opposite side.

The heat pipe 1 shown in FIG. 1 collects calories from a hot source 81 and discharges them to a cold source 82. The heat source 81 is in contact with the heat pipe near an evaporation portion 71. The cold source 82 is in contact with the heat pipe near a condensation portion 72.

The heat pipe 1 is seen as a long device closed at a first end 11 by the closure element 50, and at a second element 12 by a second closure element 50.

Figure 2:
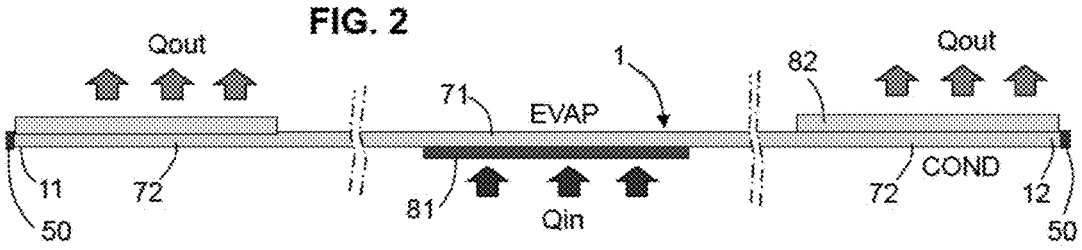
FIG. 2 schematically shows the heat pipe coupled to a heat source in an intermediate position on one side and coupled to two cold sources at the ends.

FIG. 2 shows another example where the heat pipe receives heat in one intermediate portion and discharges the heat in two end portions.

Figure 3:
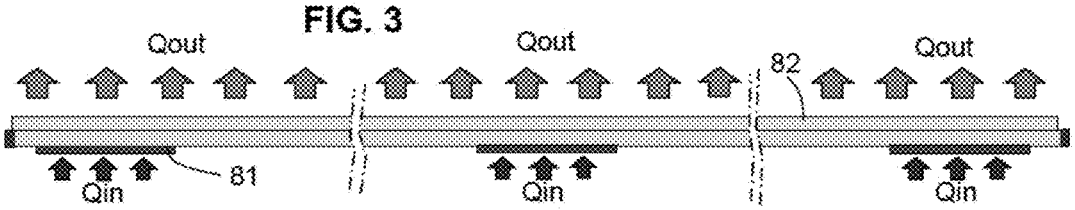
FIG. 3 schematically shows a heat pipe coupled to a continuous cold source over the length of the upper part of the heat pipe, and coupled to heat sources in the lower part of the heat pipe, and a configuration called "Heat Spreader."

FIG. 3 shows another example where the heat pipe receives heat from one side of the axis of the heat pipe (from the bottom in the example shown) and discharges the heat from the other side of the axis of the heat pipe (from the top in the example shown). It involves the configuration known in the art as "Heat Spreader".

Figure 4:
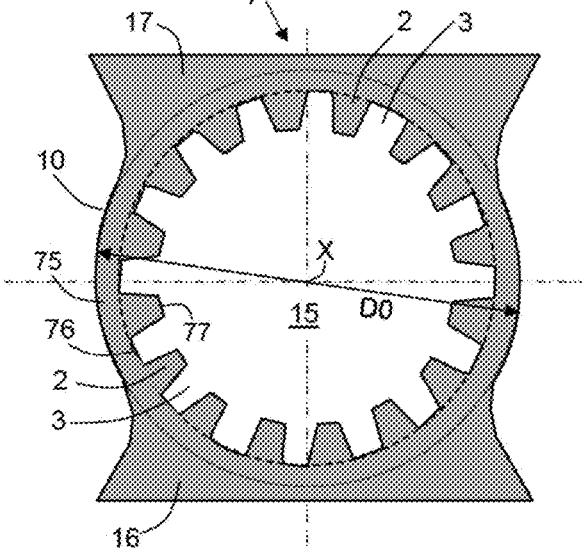
FIG. 4 shows a generally transverse section of the profiled body according to an embodiment, along the section line IV shown in FIG. 7.
Figure 5:
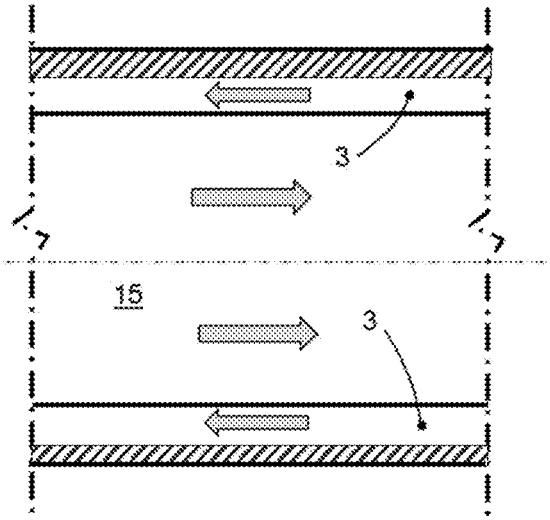
FIG. 5 shows a longitudinal section of the profiled body.
Figure 6:
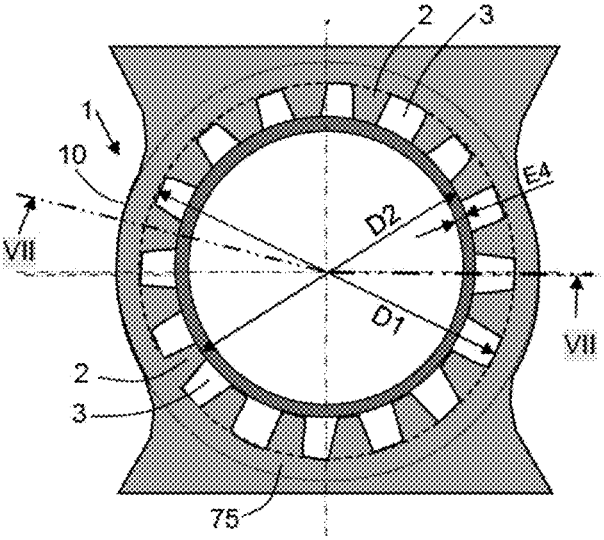
FIG. 6 shows a transverse section of the heat pipe near the circumferential transfer channel, along the section line VI shown in FIG. 7.

The heat pipe 1 generally comprises a central axial channel 15 in which the working fluid moves in gas form, and the longitudinal grooves extend axially and around the central axial channel. As shown in FIGS. 4 and 5, the longitudinal grooves, also called longitudinal channels 3, are intended to move the working fluid in liquid form forward along a direction opposite to that of the gas.

The heat pipe 1 is configured for being used in low or zero gravity. For example, this heat pipe is used in equipment and devices sent into space. In particular, this type of heat pipe is used in communication satellites, surveillance satellites and satellites having all sorts of other functions. The heat pipe 1 may be used in complete weightlessness or in a situation of low gravity for example on the surface of a celestial body like the Moon or Mars. The heat pipe 1 may be used with zero or very low external pressure.

Base Profile

The heat pipe 1 comprises a profiled body 10 obtained by extrusion. Additional operations may be done as will be seen further on. However, the extrusion operation is the main operation in fabrication. An aluminum alloy is pushed by a press through a die having the intended shapes for getting a profiled body at the outlet of the die.

In the example show in FIGS. 4 to 11, the profiled body forms a hollow body which delimits an inner space hermetically isolated from the outside environment and which will be used to contain the working fluid.

The profiled body has a section, which after extrusion, extends identically along the longitudinal axis referenced X. The profiled body could then be curved, such that the final heat pipe is not necessarily straight.

Generally, the profiled body 10 extends along a longitudinal path PX. The longitudinal path PX may be straight or curved.

The length of the path PX may be included between 0.5 m and 10 m.

The profiled body 10 comprises a peripheral tubular wall 75 from which two diametrically opposite feet 16, 17 extend radially outward. These feet each end with a bearing plane suited for exchanging calories with the cold or hot source 82, 81.

In another configuration, there could be only one foot and only one bearing plane for thermal coupling, a foot designed for incorporating integration functions or mechanical functions, or no feet at all.

In another configuration it could have four interface planes, and in a specific case the outer delimitation of the body could be substantially square or entirely cylindrical.

Figure 16:
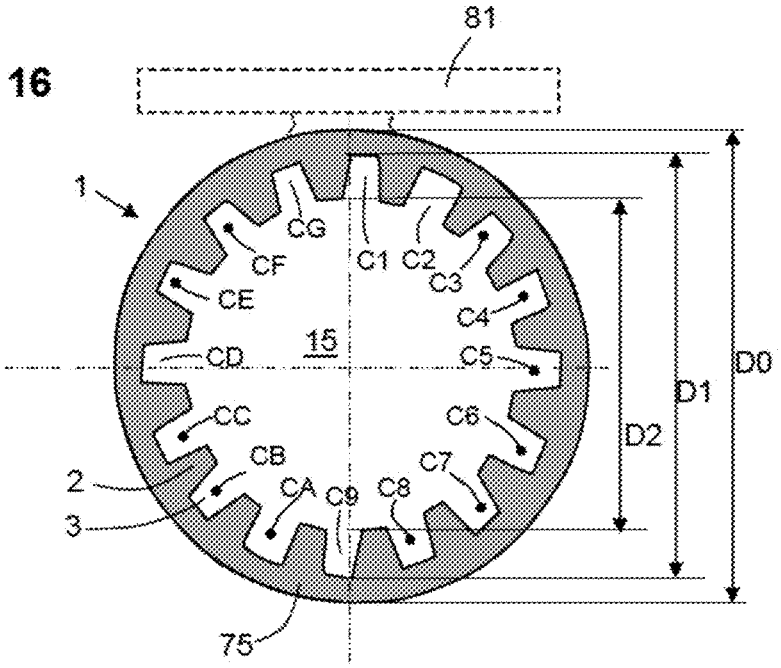
FIG. 16 shows a transverse section of the profiled body according to a second embodiment.

In yet another configuration, the thermal coupling element could be distinct and added on, as shown in FIG. 16. In this case, the profile is generally one of revolution around the X-axis, with a repetition on the inside of the [groove+divider] pattern in the circumferential direction.

The profiled body comprises a plurality of longitudinal channel 3. In practice, the longitudinal channels are made as longitudinal grooves.

Each of said longitudinal channels has a section delimited by a bottom 76 formed by a peripheral tubular wall 75 of the profiled body, and laterally by two longitudinal dividers 2 which extend radially inwards from the peripheral tubular body.

The longitudinal channel surrounds the central axial channel 15 conveying the gas. The longitudinal channels 3 are generally open in the direction of the axial channel.

In the example shown, we have 16 longitudinal dividers 2 and 16 longitudinal channels 3. Generally, the number of longitudinal channels is included between 6 and 48.

The longitudinal channels 3 are arranged annularly around the axis. However, noncircular arrangements are also possible.

The peripheral tubular wall 75 has a basic outer diameter D0. D0 may be included between 3 mm and 50 mm.

The diameter D1 represents the inner dimension of the peripheral tubular wall 75, in other words, the diameter taken near the bottom of the grooves.

The diameter D2 represents the inner dimension of the axial channel, in other words, the diameter of the circumscribed circle passing through the top 77 of the dividers.

Note that all along the profiled body, the inner space is perfectly hermetically isolated from the outside environment, because this profile is made from a single piece and all extruded together; it continuously surrounds the interior space without opening.

In that way, the problem of sealing must or should be dealt with only in the area of the longitudinal ends 11, 12. The case will be seen later of connections by butting profile to profile.

The working fluid may be ammonia, propylene, methanol or any other media having a saturated liquid-gas equilibrium at the working pressures defined by the temperature. A set quantity of working fluid is added through one of the end elements equipped with a sealable filling opening. The pressure predominating in the inner space of the heat pipe can range from 0.1 bar up to several tens of bars.

The set quantity of working fluid is defined for preferably having a limited liquid excess from the cold/condenser side, i.e., completely filled grooves and as applicable, filling the axial end of the channel on the cold side.

It should be noted that the section of the longitudinal channels 3 may take any suitable shape, since the bottom 76 is not necessarily flat, and the dividers are not necessarily straight. Preferably, the section of the longitudinal channels has a general concavity. In a particular example, the section of the longitudinal channels may be generally a circular arc or an oval arc, or even a drop shape open towards the axial channel 15. In the example shown in the figures, the section is seen as a trapezoidal section.

Passages/Circumferential Channel

Advantageously at least one circumferential transfer channel 6 is provided, arranged transversely to the local axial direction. The circumferential transfer channel 6 is located at a first position P1 along the longitudinal path PX.

We will see below several possibilities for this position P1 along the longitudinal path PX.

The circumferential transfer channel 6 provides mutual fluid communication among all the longitudinal channels. More generally, the circumferential transfer channel 6 provides mutual fluid communication among all or part of the plurality of longitudinal channels.

The circumferential transfer channel 6 is generally seen as an annular passage or groove. In practice, it is often seen as an annular throat which makes a full ring (360°) without excluding a smaller angular opening.

Figure 7:
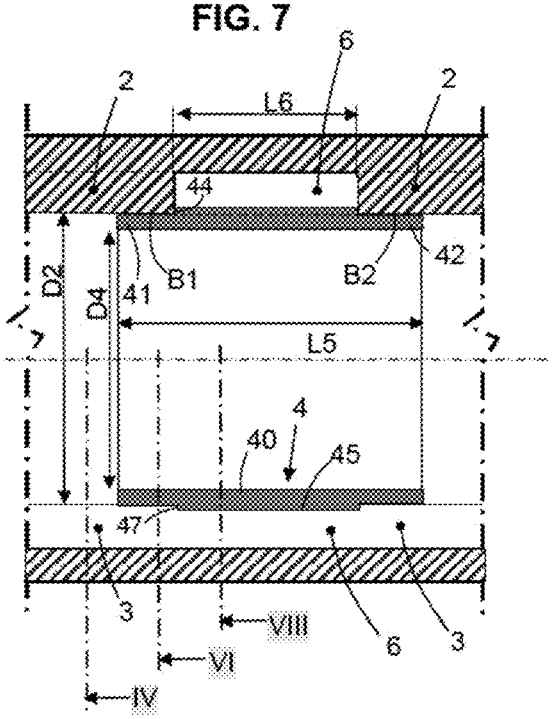
FIG. 7 shows a longitudinal section of the heat pipe in the area of the circumferential transfer channel.
Figure 8:
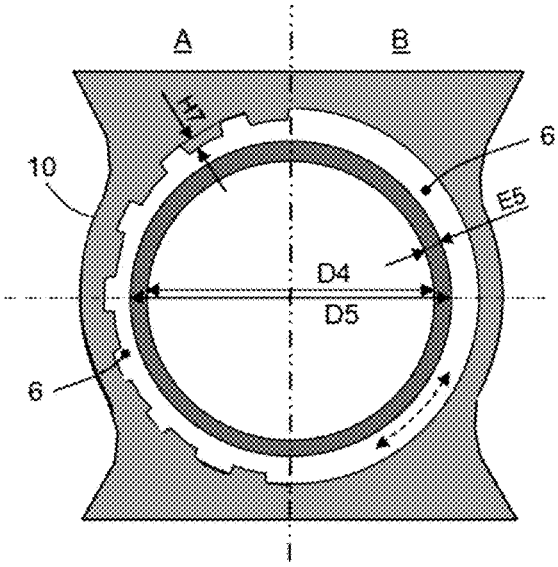
FIG. 8 shows a transverse section of the heat pipe in the area of the circumferential transfer channel, along the section line VIII shown in FIG. 7.
Figure 10:
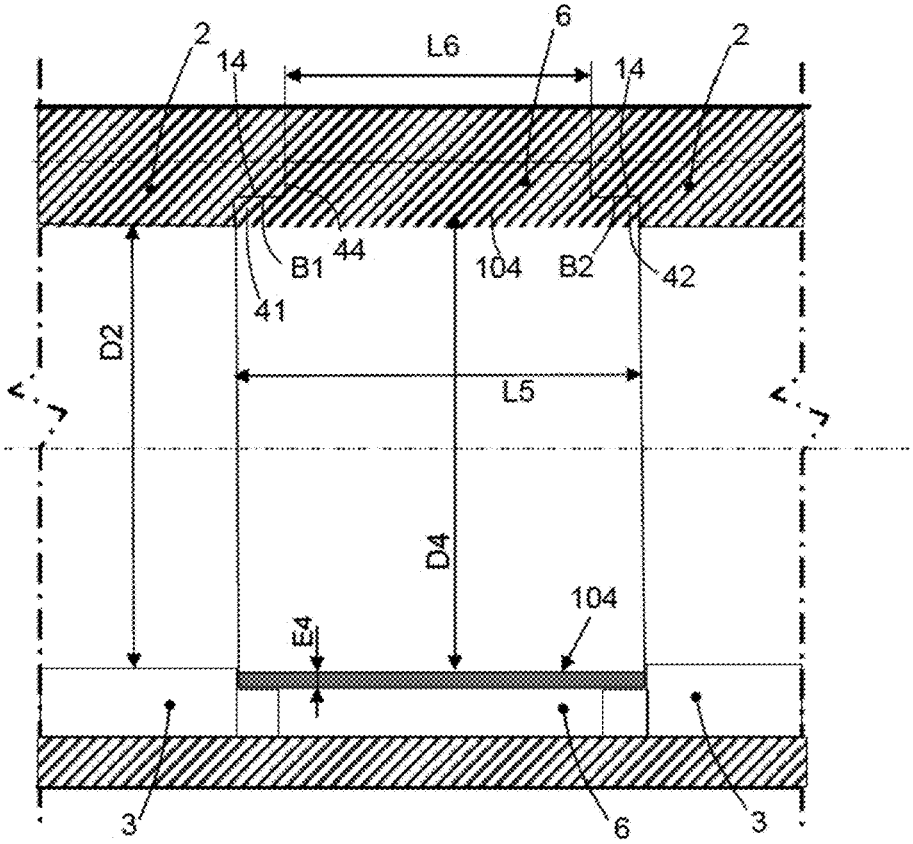
FIG. 10 is analogous to FIG. 7 and shows for an implementation variant, a longitudinal section of the heat pipe in the area of the circumferential transfer channel.
Figure 11:
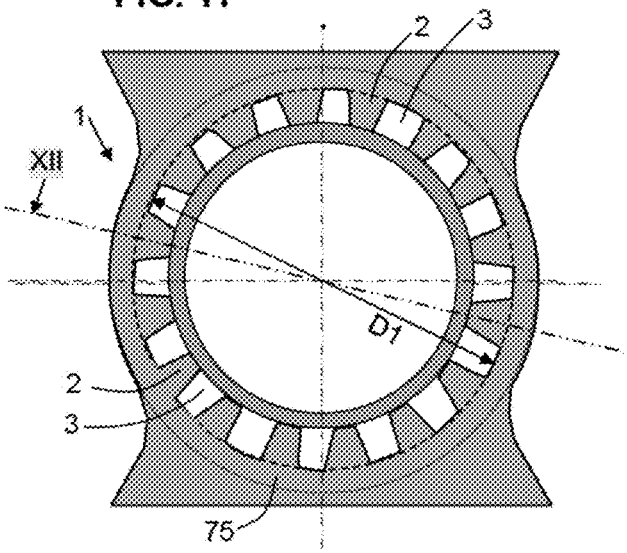
FIG. 11 shows a transverse section of the heat pipe along the section line XI shown in FIG. 12.
Figure 17:
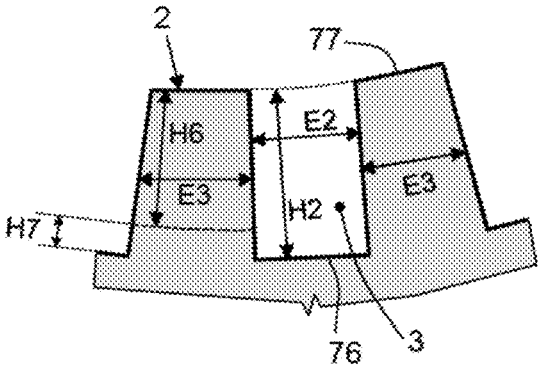
FIG. 17 shows in more detail a geometric example of the longitudinal channel and the dividers bordering it.

Referring to FIGS. 7, 10 and 17, note that the longitudinal dividers 2 are interrupted in the area of the circumferential channel 6. The material of the dividers was removed over a depth H6. Along the axis X, the circumferential transfer channel 6 has an axial length L6.

The axial length L6 of the circumferential channel may be, as in the example shown, greater than the height H2 of the grooves.

In other configurations, the axial length L6 of the circumferential channel may be less than the height H2 of the grooves.

In the example shown, a part of the divider was not removed (this corresponds to the residual height H7=H2−H6).

For example, H6 may be included between 50% and 100% of the height H2. For example, H6 may be included between 70% and 100% of the height H2.

In other configurations, the entire height of the divider could be removed (therefore H7=0).

In practice, a divider footer remains over a residual height H7 included between 0% and 50% of the height H2 of the dividers. Keeping the divider footer serves to keep longitudinal contact lines for channeling the liquid by capillarity notwithstanding the presence of the circumferential transfer channel.

Note that several circumferential transfer channels may be provided, arranged one after the other in the longitudinal direction X. Implementation of a fairly tight succession of transverse channels of small longitudinal dimension (small L6) could be planned.

Note that there is no porous layer, porous mass, or porous covering in the one or more circumferential transfer channels nor locally or generally over the length of the heat pipe. The proposed heat pipes do not have any capillary porous material intended to provide capillary pumping and are therefore easy to produce.

Covering Ring

According to an advantageous option, the circumferential transfer channel 6 is radially delimited on the inside by a covering ring 4. The covering ring 4 is interposed between the circumferential transfer channel and the axial channel. The covering ring 4 closes the circumferential transfer channel 6 radially towards the axis X.

The covering ring 4 is generally seen as a tubular body 40, otherwise called sleeve.

The covering ring 4 has an axial length L5. The axial length L5 of the covering ring is in practice chosen a little larger than the axial length L6 of the circumferential channel.

The radial thickness E5 of the covering ring, near the circumferential transfer channel, is included between 0.1 mm and 1 mm.

In position for use, the inner diameter of the ring is referenced D4.

The external diameter of the ring near the circumferential channel is referenced D5.

The covering ring 4 may be made of a deformable material, either in the elastic or plastic domain, in order to be installed in position in order to radially cover and close the circumferential channel 6.

According to the elastic deformation option, the ring is constrained radially inwards and then inserted inside the axial channel by threading and after arriving at the right axial position (i.e., the target position), the elastic constraint is released which leads to an expansion and final positioning.

According to the plastic deformation option, an initial diameter of the ring is selected slightly less than D2, and then the ring is inserted inside the axial channel by threading and after arriving at the right axial position (i.e., the target position), a radial expansion is caused by inserting a deformable tool. Then the covering ring flattens against the dividers or the bearing/flat surfaces provided for that purpose.

In order to receive the covering ring in the zone of the circumferential channel, a first-bearing zone B1 for receiving a first longitudinal end 41 of the covering ring 4 and a second bearing zone B2 for receiving a second longitudinal end 42 of the covering ring are prepared.

Figure 9:
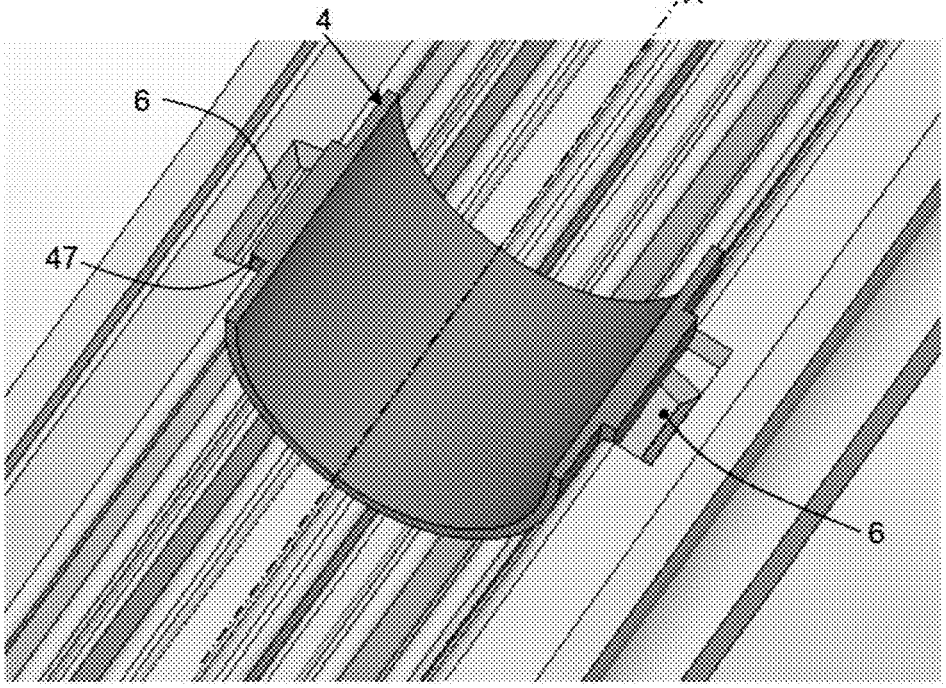
FIG. 9 shows a longitudinal half-section of the heat pipe in the area of the circumferential transfer channel.

According to a first solution shown in FIGS. 7 and 9, the covering ring 4 or may comprise a central excess thickness 45 forming a radially outward shoulder 47. The central excess thickness 45 is received between the dividers on the stop edges 44 in the area of the first and second bearing zones.

Note that in this configuration D4<D2<D5.

According to a second solution, shown in FIG. 10, the covering ring has a constant thickness E4 and the first and second bearing zones B1, B2 are formed as flat areas 14 recessed from the tops of the dividers.

Note that in this case, the diameter D4 is larger than D2, i.e., the ring is radially recessed from the summits 77 of the dividers.

The flat areas 14 are obtained by removal of material.

The covering ring forms an additional contact line which increases the capillary pressure near the circumferential channel 6. Thus, the capillary pressure near the circumferential channel 6 is greater than the capillary pressure along the longitudinal channels 3. The ring allows the full recovery of the hydraulic section here the circumferential channel in order to assure the continuity of the liquid flow.

Cap

In the case of a standard heat pipe end, closing elements 50 simply come to close the profiled body. The present disclosure however calls for using closure elements cleverly.

According to an embodiment, the circumferential channel is formed in an end cap 5 fixed to an end of the profiled body.

Figure 12:
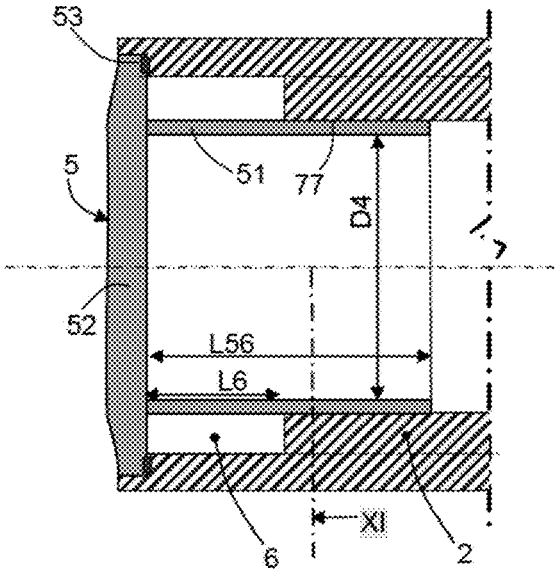
FIG. 12 shows a longitudinal section of the heat pipe in the area of one end with a recessed cap, along the section line XII shown in FIG. 11.

According to a first cap solution, shown in FIG. 12, the cap comprises an inner sleeve 51 and a closing disk 52. The disk is welded/sealed on the end of the profiled body 10 near a hermetic joint 53 for secure attachment. The closure disk 52 is thick enough to withstand the internal pressure. On the other hand, the inner sleeve 51 does not support any substantial force and it is sufficient that the axial length L65 of the sleeve be greater than the axial length L6 of the circumferential channel in order to come flush with the summits 77 of the walls 2.

The circumferential channel 6 is obtained by removal of material from the dividers on the end portion thereof. This machining is relatively standard, inserting a cutter at the axially prescribed diameter in the end portion of the body 10 is sufficient.

Figure 15:
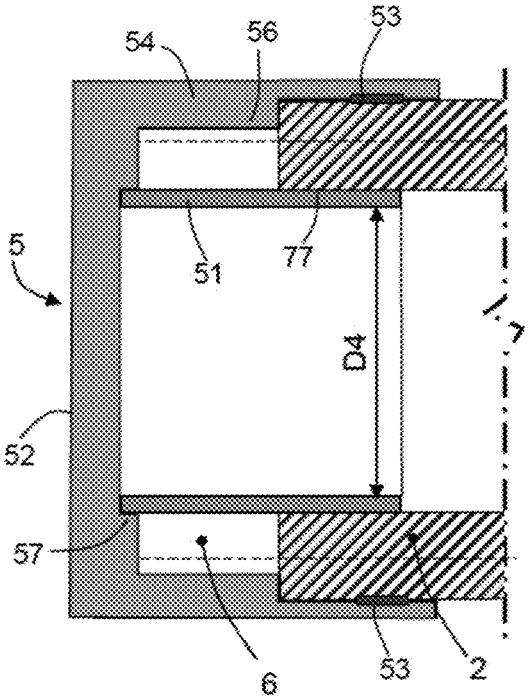
FIG. 15 shows, in an implementation variant, a longitudinal section of the heat pipe in the area of one end, with a recessed cap.

According to a second cap solution, shown in FIG. 15, the cap comprises an inner sleeve 51. The inner sleeve 51 may be distinct from the closure disk 52 or else made according to a single unit approach. When it is distinct, the inner sleeve 51 is received in a bottom circular housing 57 of the closure disk, and is seen as an easy-to-obtain part: simple tubular sleeve.

There again a sealed closure joint 53 is provided which connects the outer collar 54 of the cap 5 to the profiled body 10.

Note that here too the longitudinal dividers 2 are interrupted in the area of the circumferential channel. The outer limit of the circumferential channel is formed by a thickness 56 of the cap projecting radially inwards.

Operation and Other Specifics

In a situation of weightlessness, the forces of gravity are negligible compared to the forces resulting from the phenomenon of capillarity. Thus the physical phenomenon of capillarity is predominant, involving forces and pressures applied on various liquid parts present in the heat pipe.

The first position P1 for the circumferential transfer channel is selected near an evaporation portion 71 the heat pipe coupled to a heat source. The circumferential transfer channel is filled with liquids and the pressure differences between different grooves are equalized in that area.

Meniscuses M form in the longitudinal channels; they are even more hollowed when the pressure difference is greater along the groove, in particular in the longitudinal direction between the cold sources corresponding to the lowest pressures and the hot sources corresponding to the highest pressures.

Figure 13A:
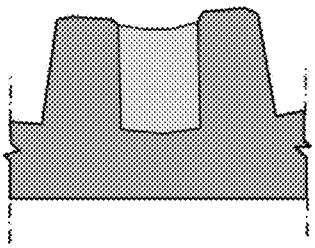
FIGS. 13A, 13B, 13C, shows various shapes of the meniscus of the liquid phase of the working fluid inside the longitudinal channel.
Figure 13B:
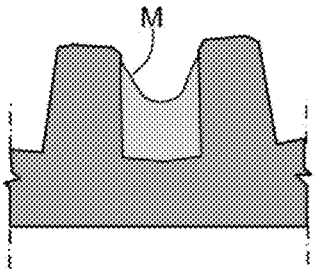
Figure 13C:
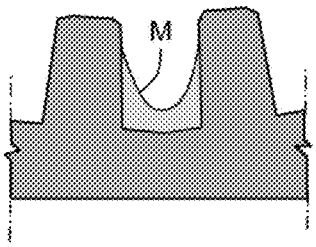

Thus in FIG. 13A, the meniscus is nearly flat. In FIG. 13B, the meniscus is more hollowed. In FIG. 13C, the meniscus is even more hollowed.

A meniscus forms in the circumferential transfer channel, which allows liquid to move in a circumferential direction and transit from one longitudinal channel to another.

Figure 14A:
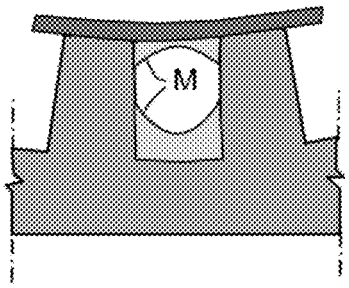
FIGS. 14A, 14B, shows various shapes of the meniscus of the liquid phase of the working fluid inside the circumferential transfer channel.
Figure 14B:
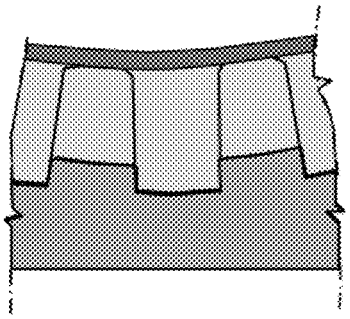

At the moment of initiating, such as shown in FIG. 14A, in the ring as well as the bottom of the longitudinal channel a meniscus is formed. FIG. 14B shows a stable regime where the entire volume of the circumferential transfer channel is filled with liquid.

In other words, the meniscus forms only transitorily in the circumferential channel, and in an established regime, it is the meniscuses of the longitudinal channels, hollower downstream than upstream, which generate the flow rate in the circumferential groove.

In that way, the recirculation groove is designed for having a greater capillary pumping than the longitudinal groove in order to properly prime with liquid.

Referring to FIG. 16, the channel C1 is under the most thermal demand, it receives calories by a short conducting channel; it is in this area that the vaporization flow rate is the greatest. The neighboring channels C2, CG also participate in the vaporization, but slightly less. The channels a little farther away C2, CG and following participate a little less in the vaporization, depending on the intensity of the heat flow, until no longer participating at all in the vaporization for the farthest grooves, when all the entering flow was vaporized. Advantageously, the presence of a circumferential transfer channel near the heat source serves to make the liquid transit towards the channel C1 that did not arrive by C1 over the length thereof. In other words, the neighboring channels supply liquid to the first channel C1.

Not only the direct or indirect neighbors, but all the other channels may participate in providing liquid for avoiding a local drying at the point under the most demand.

In the case of top loading as shown in FIG. 16, the channels CG, C1, C2 will be supplied by all the other channels, i.e., C3, C4, C5, C6, C7, C8, C9, CA, CB, CC, CD, CE, CF.

Stated differently, the circumferential transfer channel has a function of connecting and sharing the supply of liquid. It supplies liquid from the other channels to the longitudinal channel 3 most in need.

Various Other Points

The closure ring supports the supply of the circumferential transfer channel with a liquid.

But also the ring supports the passage in a straight line in a specific longitudinal channel.

If the closure ring is slightly withdrawn compared to the top of the dividers, it has a favorable effect on the passage of the liquid in a straight line in a longitudinal channel.

Further, one or more other circumferential channels are provided on the path at distinct axial positions (P2, P3, P4) different from the first position (P2).

Figure 18:
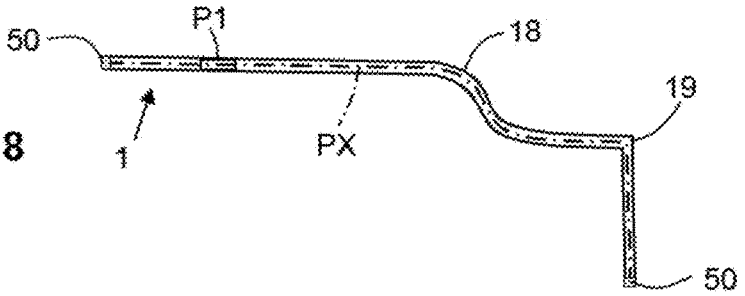
FIG. 18 shows the example of a general path of a heat pipe in which the disclosure can be practiced.

As shown in FIG. 18, the path PX may comprise one or more curves 18 and as applicable may even comprise one or more right angles 19.

Figure 19:
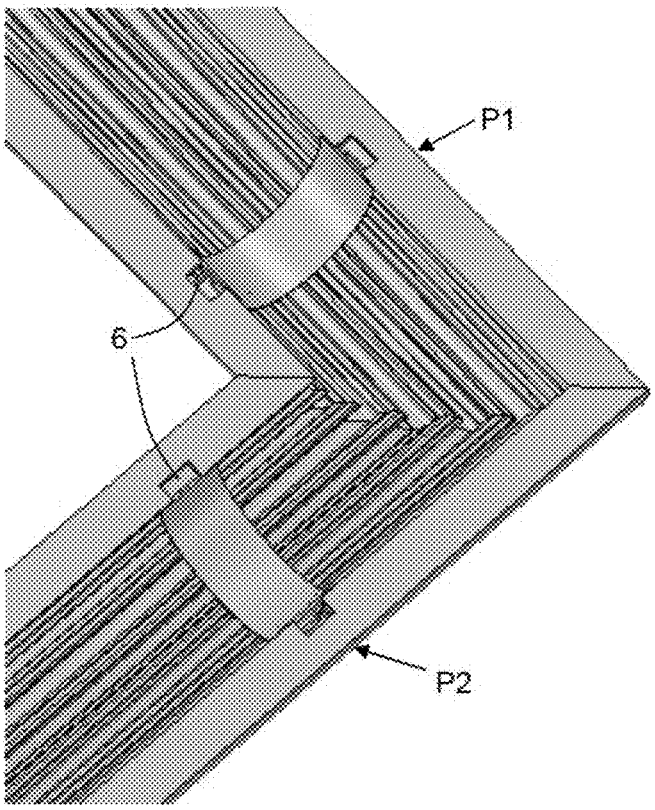
FIG. 19 shows a longitudinal half-section of the heat pipe in the area of a right-angle connection with two circumferential transfer channels.

FIG. 19 shows a longitudinal half-section of the heat pipe in the area of a right-angle connection with two circumferential transfer channels. In the case shown, two profiled bodies are joined end-to-end at 45° in order to form a right angle in this area; there is a disequilibrium in meniscus formation between the well-irrigated outer grooves and the somewhat dry inner grooves. The presence of one or two circumferential transfer channels in the area of the angle serves to equalize the pressures between the various longitudinal channels.

Figure 20:
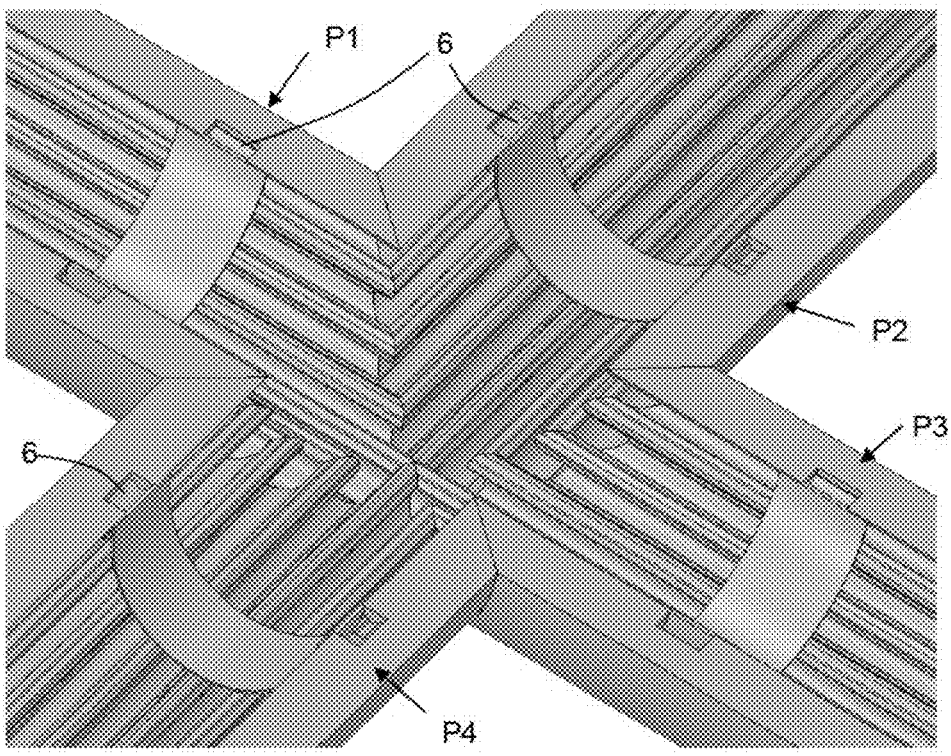
FIG. 20 shows a longitudinal half-section of the heat pipe in the area of a cross-connection with four circumferential transfer channels.

FIG. 20 shows a longitudinal half-section of the heat pipe in the area of a cross-connection with four circumferential transfer channels. This configuration is an extrapolation from the previous case shown in FIG. 19 with four profiles joined end-to-end at a cross intersection. The presence of four circumferential channels in the area of the angle serves to equalize the pressures between the various longitudinal channels.

Near intersections, outer attachments sleeves are expected with which to assure mechanical cohesion and sealing, generally obtained by welding.

As for dimensional considerations, L6 may be chosen to be included between 0.1 D0 and 0.5 D0. Also observed that D0>D1>D2.

As for the height of the dividers, a value for H2 included between 0.05 D1 and 0.2 D1 may be chosen.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A heat pipe configured for being used in low or zero gravity, comprising:

a profiled body that extends along a longitudinal path, and where said profiled body forms a hollow body closed at at least two ends by closing elements, thereby forming an interior space hermetically isolated from the outside environment and filled with a predefined volume of diphasic working fluid, said profiled body including:

a plurality of longitudinal channels, where each longitudinal channel has a section delimited by a bottom formed by a tubular wall of the profiled body, and laterally by two longitudinal dividers which extend radially inwards from the peripheral tubular wall, where the longitudinal channels surround an axial channel, and where the longitudinal channels are open towards the axial channel, and a circumferential transfer channel, which is arranged transversely to a local axial direction and extends around the local axial direction over an angular range, said angular range being 360° to provide mutual fluid connection between all of the plurality of longitudinal channels, or said circumferential transfer channel extending only over an angular range being less than 360° to provide mutual fluid connection between part of the plurality of longitudinal channels, said circumferential transfer channel being provided at at least one first position along the longitudinal path, wherein the longitudinal dividers are interrupted, partially or completely, in the area of the circumferential transfer channel, and the circumferential transfer channel is radially delimited over said angular range by a covering ring, where the covering ring is interposed between the circumferential transfer channel and the axial channel.

2. The heat pipe according to claim 1, wherein the circumferential transfer channel is arranged at an intermediate position along the longitudinal path, where the longitudinal dividers are interrupted over a predefined length in the area of the intermediate position.

3. The heat pipe according to claim 2, wherein the longitudinal dividers include a first bearing zone for receiving a first longitudinal end of the covering ring and a second bearing zone for receiving a second longitudinal end of the covering ring.

4. The heat pipe according to claim 3, wherein the covering ring includes a central excess thickness forming a radially outward shoulder received between the longitudinal dividers in the area of the first and second bearing zones.

5. The heat pipe according to claim 3, wherein the covering ring has a constant thickness and the first and second bearing zones are formed as flat areas recessed from a summit of the longitudinal dividers.

6. The heat pipe according to claim 1, wherein the at least one first position is selected near an evaporation portion of the heat pipe coupled to a heat source.

7. The heat pipe according to claim 1, wherein the at least one first position is an intermediate position along the longitudinal path.

8. The heat pipe according to claim 1, wherein the at least one first position is an end position on the longitudinal path.

9. The heat pipe according to claim 1, wherein the circumferential transfer channel is formed in an end cap fixed to an end of the profiled body.

10. The heat pipe according to claim 1, wherein one or more other circumferential transfer channels are provided on the path at distinct axial positions different from the at least one first position.

11. The heat pipe according to claim 1, wherein a plurality of circumferential transfer channels are provided along a length of the profiled body, at uniformly spaced axial positions, with a predetermined step.

12. The heat pipe according to claim 1, comprising one or more intersections with two circumferential transfer channels arranged on either side of each intersection.

13. The heat pipe according to claim 1 formed like a three-dimensional object.

14. A heat pipe configured for being used in low or zero gravity, comprising:

a profiled body that extends along a longitudinal path, and where said profiled body forms a hollow body closed at at least two ends by closing elements, thereby forming an interior space hermetically isolated from the outside environment and filled with a predefined volume of diphasic working fluid, said profiled body including:

a plurality of longitudinal channels, where each longitudinal channel has a section delimited by a bottom formed by a peripheral tubular wall of the profiled body, and laterally by two longitudinal dividers which extend radially inwards from the peripheral tubular wall, where the longitudinal channels surround an axial channel, and where the longitudinal channels are open towards the axial channel, and a circumferential transfer channel, which is arranged transversely to a local axial direction and provides mutual fluid connection between all or part of the plurality of longitudinal channels, is provided at at least one first position along the longitudinal path, wherein the longitudinal dividers are interrupted, partially or completely, in the area of the circumferential transfer channel;

wherein the circumferential transfer channel is radially delimited by a covering ring, where the covering ring is interposed between the circumferential transfer channel and the axial channel; and wherein the circumferential transfer channel does not include capillary porous material for capillary pumping.

15. The heat pipe according to claim 14, wherein the circumferential transfer channel is arranged at an intermediate position along the longitudinal path, where the longitudinal dividers are interrupted over a predefined length in the area of the intermediate position.

16. The heat pipe according to claim 14, wherein the circumferential transfer channel is radially delimited by a covering ring, where the covering ring is interposed between the circumferential transfer channel and the axial channel.

17. The heat pipe according to claim 16, wherein the longitudinal dividers include a first bearing zone for receiving a first longitudinal end of the covering ring and a second bearing zone for receiving a second longitudinal end of the covering ring.

18. The heat pipe according to claim 17, wherein the covering ring includes a central excess thickness forming a radially outward shoulder received between the longitudinal dividers in the area of the first and second bearing zones.

19. The heat pipe according to claim 14, wherein the at least one first position is an end position on the longitudinal path.

* * * * *